US005996488A

United States Patent [19]

Yanagisawa et al.

[11] Patent Number: 5,996,488

[45] **Date of Patent: *Dec. 7, 1999**

[54] PREPARATION OF AN ELECTRON SOURCE BY OFFSET PRINTING ELECTRODES HAVING THICKNESS LESS THAN 200 NM

[75] Inventors: Yoshihiro Yanagisawa, Fujisawa; Tetsuya Kaneko, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/561,868

[22] Filed: Nov. 22, 1995

[30] Foreign Application Priority Data

Nov. 25, 1994 [JP] Japan ..... 6-291310

[51] Int. Cl.[6] ..... B41M 1/10; H01J 1/30

[52] U.S. Cl. ..... 101/170; 101/129; 101/154; 101/491; 313/310

[58] Field of Search ..... 101/150, 153, 101/154, 163, 170, 483, 491, 492, 129; 313/309, 310, 495, 496

[56] References Cited

U.S. PATENT DOCUMENTS

| | | | |
|---|---|---|---|
| 4,209,551 | 6/1980 | Masaki et al. | 427/68 |
| 4,479,432 | 10/1984 | Masaki et al. | 101/170 |
| 5,066,883 | 11/1991 | Yoshioka et al. | 313/309 |
| 5,127,330 | 7/1992 | Okazaki et al. | 101/491 |
| 5,201,268 | 4/1993 | Yamamoto et al. | 101/170 |
| 5,272,980 | 12/1993 | Takeuchi et al. | 101/170 |
| 5,312,643 | 5/1994 | Yamamoto et al. | 427/108 |
| 5,362,513 | 11/1994 | Shimada et al. | 101/170 |
| 5,366,760 | 11/1994 | Fujii et al. | 427/96 |

FOREIGN PATENT DOCUMENTS

| | | | |
|---|---|---|---|
| 183283 | 10/1983 | Japan | 101/150 |
| 191188 | 11/1983 | Japan | 101/170 |
| 04290295 | 10/1992 | Japan . | |
| 280495 | 10/1992 | Japan | 101/150 |
| 241172 | 9/1993 | Japan . | |
| 2066159 | 7/1981 | United Kingdom | 101/170 |

OTHER PUBLICATIONS

M.I. Elinson et al., Radio Engineering and Electronic Physics, v.10, pp. 1290–1296, Jul. 1965.

G. Dittmer, Thin Solid Films, v. 9, pp. 317–328, 1972.

M. Hartwell et al., International Electron Devices Meeting, Washington D.C., 1975, IEDM Technical Digest, pp. 519–521.

H. Araki et al., Journal of the Vacuum Society of Japan, v. 26, No. 1, pp. 22–29, 1983.

*Primary Examiner*—Stephen R. Funk

*Attorney, Agent, or Firm*—Fitzpatrick, Cella, Harper & Scinto

[57] ABSTRACT

A method of producing a substrate for an electron source, the substrate including a plurality of electron emission devices each including a pair of opposing electrodes, the plurality of electron emission devices being arranged on the substrate. The method comprises the steps of preparing an intaglio plate having recessed portions corresponding to a pattern of the electrodes, the depth of the recessed portions being in the range from 4 $\mu$m to 15 $\mu$m, filling the recessed portions with ink, pressing a blanket against the intaglio plate so that the ink is transferred from the inside of the recessed portions onto the blanket, and bringing the blanket into contact with the substrate so that the ink is transferred from the blanket onto the substrate thereby forming the electrode pattern thereon.

26 Claims, 8 Drawing Sheets

PREPARATION OF AN ELECTRON SOURCE BY OFFSET PRINTING ELECTRODES HAVING THICKNESS LESS THAN 200 NM

BACKGROUND OF THE INVENTION

1. Field of the Invention

The present invention relates to a method of producing a substrate for an electron source by means of an offset printing technique, and to a method of producing an image-forming apparatus. More specifically, the present invention relates to a method of producing a larger-sized image-forming apparatus.

2. Related Background Art

In recent years, increasing intention has been given to an image-forming apparatus in the form of a thin flat panel which is expected to replace a cathode-ray tube (CRT) having disadvantages of great size and weight. Among various types of flat panel image-forming apparatus, liquid crystal display devices are extensively investigated. However, the liquid crystal display device still has a problem that the brightness of a displayed image is not high enough. Another remaining problem is that the view angle is limited to a narrow range. Emission type displays such as a plasma display device, a fluorescent display device, and a display device using an electron-emitting device are promising candidates for a display device that may replace the liquid crystal display device. These emission type display apparatus can offer a brighter image and a wider angle of view than liquid crystal display devices. On the other hand, there is a need for a larger-sized display device. To meet such a requirement, large-sized CRTs having a display area greater than 30 inches have been developed recently, and still greater CRTs are expected. However, the larger the display area of a CRT, the larger the space needed to install the CRT. This means that CRTs are not very suitable for providing a large display area. In contrast, flat panel display devices of the emission type with a rather small-sized body can offer a large display screen size, and thus they are now attracting the greatest intention. From this point of view, among various flat panel image-forming apparatus of the emission type, an image-forming apparatus using electron-emitting devices is very promising. In particular, the image-forming apparatus using a surface conduction electron-emitting device, proposed by M. I. Elinson et. al. (Radio. Eng. Electron. Phys., 10, 1290 (1965)) is attractive in that electrons can be emitted by a simple device.

In surface conduction electron-emitting devices, a thin film with a small size is formed on a substrate so that electron emission occurs when a current flows through the thin film in a direction parallel to the film surface. Various types of surface conduction electron-emitting devices are known. They include a device using a thin $SnO_2$ film proposed by Elinson et. al., a device using a thin Au film (G. Dittmer, Thin Solid Films, 9, 317 (1972)), a device using a thin $In_2O_3/SnO_2$ film (M. Hartwell and C. G. Fonstad, IEEE Trans. ED Conf., 519 (1975)), and a device using a thin carbon film (Araki et. al., Vaccuum, 26(1), 22 (1983)).

The device proposed by M. Hartwell et. al. is taken here as a representative example of a surface conduction electron-emitting device, and its structure is shown in FIG. 9. In FIG. 9, reference numeral 1001 denotes a substrate. Reference numeral 1004 denotes an electrically-conductive thin film which is formed of a metal oxide into an H pattern by means of sputtering. The electrically-conductive thin film 1004 is subjected to a process called energization forming, which will be described in greater detail later, so that an electron emission region 1005 is formed in the electrically-conductive thin film 1004. The portion of the electrically-conductive thin film 1004 between electrodes has a length L in the range from 0.5 mm to 1 mm and a width of 0.1 mm.

The inventors of the present invention have proposed a surface conduction electron-emitting device in which particles having the capability of emitting electrons are dispersed in a region between a pair of device electrodes, as disclosed in U.S. Pat. No. 5,066,883. This electron-emitting device has an advantage that electron emission positions can be controlled more precisely than the above-described other conventional surface conduction electron-emitting devices. FIGS. 3A and 3B illustrate a typical structure of the surface conduction electron-emitting device according to this technique disclosed in U.S. Pat. No. 5,066,883. This surface conduction electron-emitting device includes an insulating substrate 31, device electrodes 32 and 33 used to make electric connections, and an electrically-conductive thin film 34 containing electrically-conductive particles. An electron emission region 35 is formed in the conductive film 34. In this surface conduction electron-emitting device, the distance L between a pair of the device electrodes is preferably set to a value in the range from 0.01 $\mu$m to 100 $\mu$m, and the sheet resistance of the electron emission region 35 is preferably set to a value in the range from $1\times10^{-3}$ Ω/□ to $1\times10^{-9}$ Ω/□. The device electrodes preferably have a thickness less than 200 nm so that the electrodes can have good electrical contact with the thin film 34 made of the conductive particles. When a great number of similar devices are arranged, it is important that there are small variations in the width and length of the portion of the thin film between the two electrodes so as to achieve small variations in the electron emission characteristics. FIGS. 4A to 4C illustrate the process of producing the electron-emitting device shown FIGS. 3A and 3B.

The inventors of the present invention have investigated a technique of achieving a greater-sized image-forming apparatus by disposing a great number of surface conduction electron-emitting devices on a substrate. There are various techniques to form an electron source substrate having electron-emitting devices and interconnections on the substrate. One of the techniques is to form all device electrodes and interconnections by means of photolithography. However, when the technique based on the photolithography is used to produce a large-sized image-forming apparatus, a large-scale exposure tool is required in the production. Furthermore, in this technique, a handling problem occurs and thus it is difficult to form a great number of devices having good characteristics with small variations on a substrate.

Another technique is to employ a printing technique such as a screen printing or offset printing technique to produce a circuit substrate. The printing technique is suitable for forming a pattern over a large area. Besides, this technique is inexpensive. An example of a technique of producing a circuit substrate by means of offset printing is disclosed in Japanese Patent Application Laid-Open No. 4-290295. In this technique disclosed in Japanese Patent Application Laid-Open No. 4-290295, the angles of plural electrodes for electrical connection to circuit components are varied so as to avoid an electrical contact failure due to the variation in the electrode-to-electrode pitch which arises from the expansion and contraction during a printing process. Furthermore, Japanese Patent Application Laid-Open No. 4-290295 discloses a technique of forming electrode patterns by means of offset printing.

However, if an electron source substrate is produced using a simple offset printing technique to form a large number of surface conduction electron-emitting devices on a substrate, great variations occur in the electron emission characteristics among the surface conduction electron-emitting devices disposed on the substrate. As a result, an image-forming apparatus obtained using this electron source substrate will have a poor image quality. This is mainly due to the variation in the shape of the device electrode across the substrate. In particular, there is a great variation in the shape between a central part and a peripheral region of the substrate.

SUMMARY OF THE INVENTION

It is an object of the present invention to solve the above problems in the production of a substrate for an electron source and an image-forming apparatus.

More specifically, it is an object of the present invention to provide a method of producing a substrate for an electron source wherein a plurality of electron-emitting devices are formed on the substrate by means of offset printing so that no variation or substantially no variation occurs in the size of electrodes of electron-emitting devices thereby ensuring that the electron-emitting devices have uniform characteristics. It is another object of the present invention to provide a method of producing an image-forming apparatus capable of displaying a high-quality image.

To achieve the above objects, the present invention provides a method of producing a substrate for an electron source, the substrate including a plurality of electron emission devices each including a pair of opposing electrodes, the plurality of electron emission devices being arranged on the substrate, the method comprising the steps of: preparing an intaglio plate having recessed portions corresponding to a pattern of the electrodes, the depth of the recessed portions being in the range from 4 $\mu$m to 15 $\mu$m; filling the recessed portions with ink; pressing a blanket against the intaglio plate so that the ink is transferred from the inside of the recessed portions onto the blanket; and bringing the blanket into contact with the substrate so that the ink is transferred from the blanket onto the substrate thereby forming the electrode pattern thereon.

The present invention also provides a method of producing an image forming apparatus, the image forming apparatus including a substrate for an electron source and a front plate on which a fluorescent material is disposed, the substrate for the electron source and the front plate being disposed so that they face each other, the substrate for the electron source including a plurality of electron emission devices each including a pair of opposing electrodes, the plurality of electron emission devices being arranged on the substrate, the electron emission devices being adapted to emit electrons so that the electrons strike the fluorescent material thereby forming an image, the method comprising the steps of: preparing an intaglio plate having recessed portions corresponding to a pattern of the electrodes, the depth of the recessed portions being in the range from 4 $\mu$m to 15 $\mu$m; filling the recessed portions with ink; pressing a blanket against the intaglio plate so that the ink is transferred from the inside of the recessed portions onto the blanket; and bringing the blanket into contact with the substrate so that the ink is transferred from the blanket onto the substrate thereby forming the electrode pattern thereon and thus obtaining the substrate for an electron source.

DESCRIPTION OF THE PREFERRED EMBODIMENTS

Figure 1A:
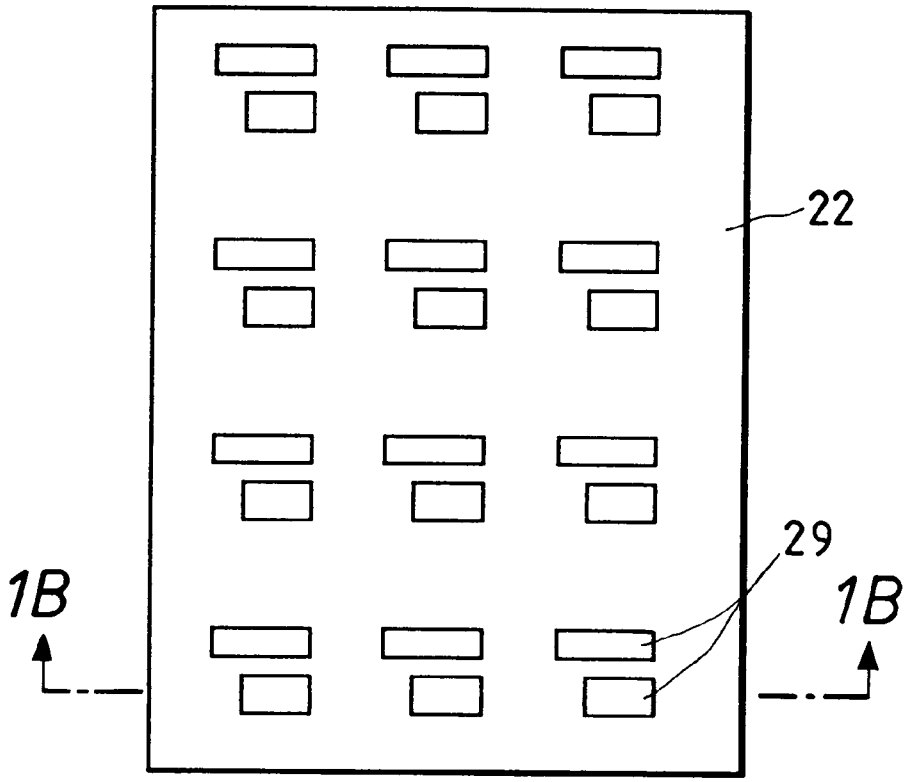
FIGS. 1A and 1B are schematic diagrams illustrating an intaglio plate according to the present invention.
Figure 1B:
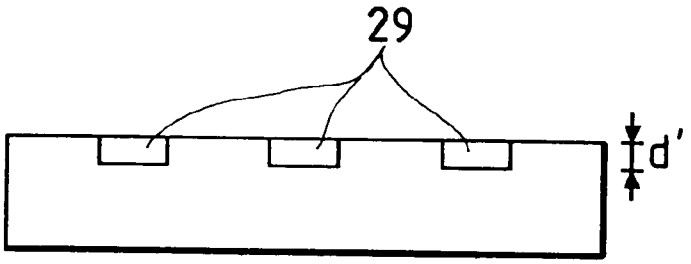

The method of producing a substrate for an electron source and an image-forming apparatus according to the present invention will be described in further detail below.

In this invention, the depth of recessed portions of the intaglio plate is preferably in the range from 4 $\mu$m to 15 $\mu$m. Recessed portions having a rather small depth are formed on an intaglio plate so that the penetration of the blanket surface into the recessed portions is mechanically limited and thus the deformation of a printed pattern can be avoided without having to perform fine adjustment of the intaglio plate pressure. This means that this technique can reduce the variation in the shape of the device electrode between central and peripheral areas of a substrate thereby ensuring that a plurality of electron-emitting devices can be formed on the substrate with small variations in the length of the device electrodes the gap (width) between the electrodes, and the thickness of the electrodes. Thus, the present invention provides an electron source substrate having electron-emitting devices with uniform characteristics and also an image-forming apparatus using this electron source substrate.

Furthermore, in the present invention, since the recessed portions of the intaglio plate have a rather small depth, it is possible to transfer the ink from the inside of the recessed portions of the intaglio plate onto the blanket with a high efficiency (ink transfer efficiency) nearly equal to 100%. This avoids a problem due to residual ink remaining in the recessed portions without being transferred.

In the present invention, the depth of the recessed portions is preferably in the range from 4 $\mu$m to 15 $\mu$m, more preferably 4 $\mu$m to 12 $\mu$m, and most preferably 7 $\mu$m to 9 $\mu$m.

In this invention, the viscosity of the ink paste should not be too high because the high viscosity results in difficulty in removing ink from the recessed portions and thus creates a difficulty in transferring ink to the blanket. On the other hand, if the viscosity of the ink is too low, the fluidity of the ink results in poor uniformity of the device electrode pattern. Thus, in the present invention, it is preferable that the viscosity of the ink be in the range from 1000 cps to 10000 cps and more preferably in the range from 1000 cps to 5000 cps. The use of the ink with the viscosity in the range described above makes it possible to form electrode patterns having a small thickness less than 200 nm with a very small variation in the thickness. The ink paste is preferably of the resinate paste type containing 7% to 15% of platinum (Pt) or gold (Au). Although the present invention is not limited to a particular range of printing pressure, it is desirable that the printing pressure be adjusted so that the amount of blanket penetration falls in the range from 50 μm to 200 μm so as to achieve good reproducibility in producing a great number of electron-emitting devices, electron source substrates including the electron-emitting devices, and image-forming apparatus. Furthermore, to achieve good ink transfer, it is preferable to employ a blanket covered with silicone rubber. This is desirable in particular when the ink is transferred onto a substrate material having no ability of absorbing ink, such as a glass substrate.

Now, the method of producing an image-forming apparatus with the substrate for an electron source according to the present invention will be described below. That is, an image-forming apparatus is produced as follows:

(1) First, a plurality of pairs of opposing device electrodes are formed in a matrix form on a substrate.

(2) Interconnections are then formed into a matrix form so that the device electrodes are connected via these interconnections.

(3) An electrically-conductive thin film serving as an electron emission region is formed between the opposing device electrodes. Thus, an electron source substrate is obtained.

(4) A front plate is produced by coating a fluorescent material on the surface of a transparent substrate.

(5) The substrate for the electron source and the front plate are disposed so that they face each other thereby forming a vacuum chamber.

(6) The inside of the vacuum chamber is evacuated. Then energization forming and gettering are performed. Thus, an image-forming apparatus is obtained.

Figure 8:
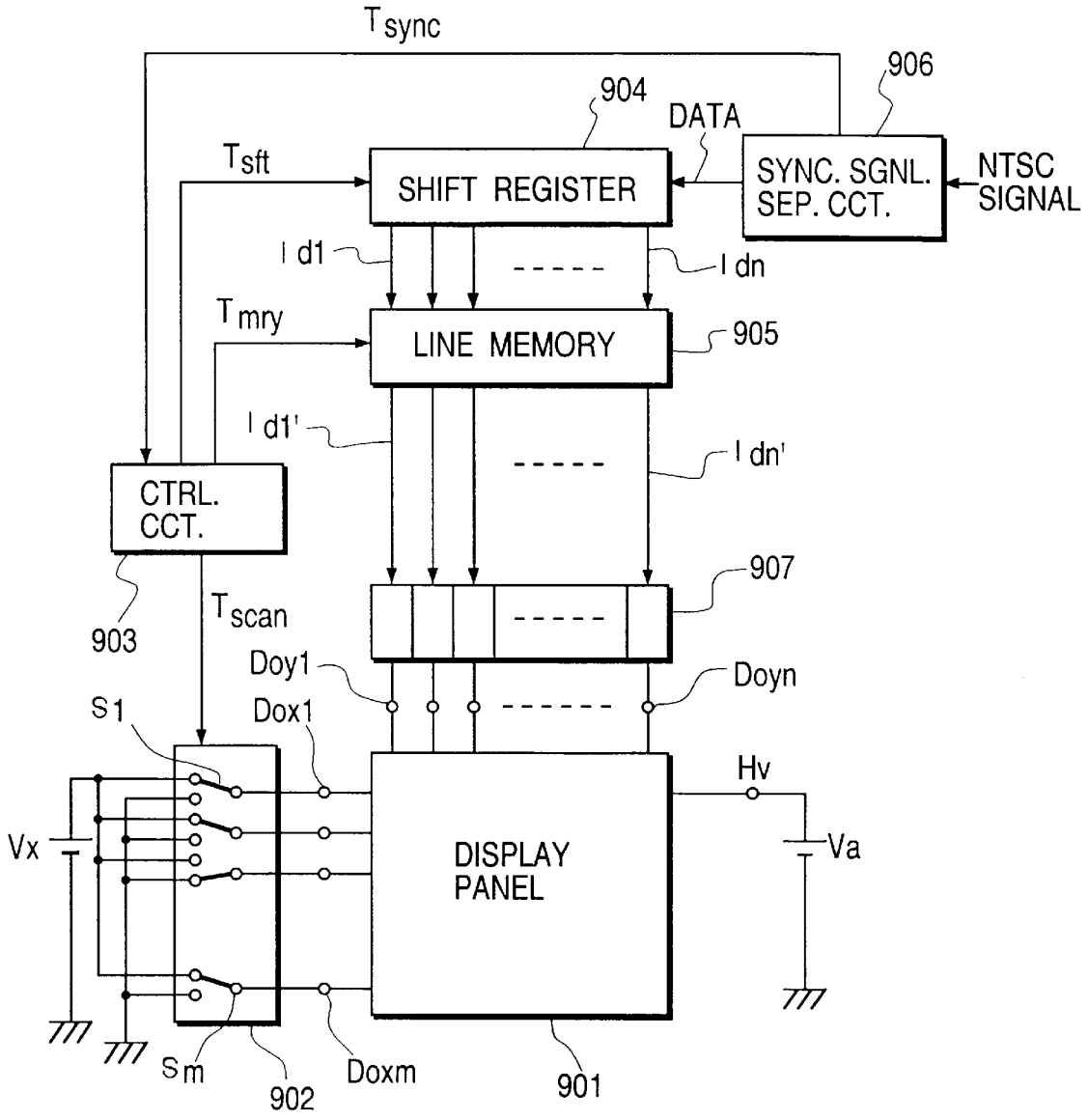
FIG. 8 is a circuit diagram illustrating an example of a driving circuit.
Figure 2A:
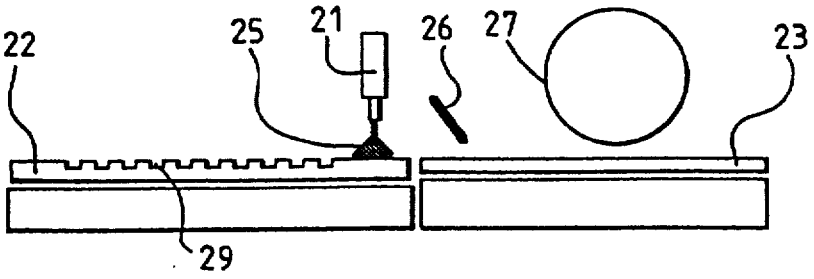
Figure 2B:
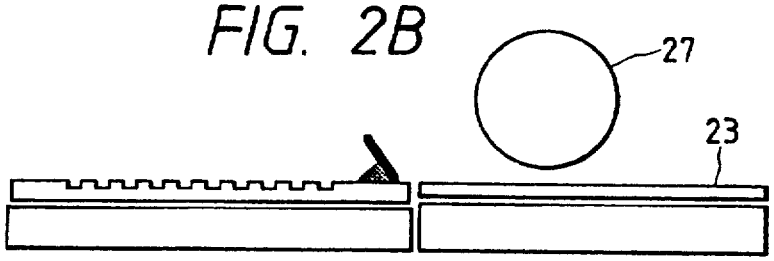
Figure 2C:
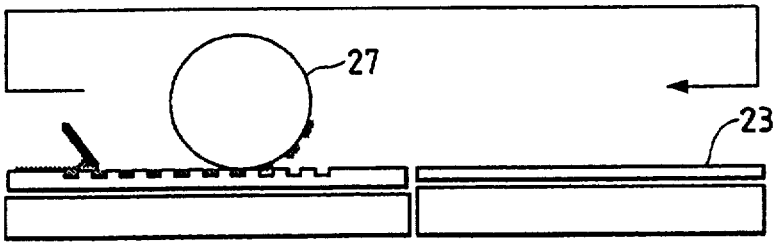
Figure 2D:
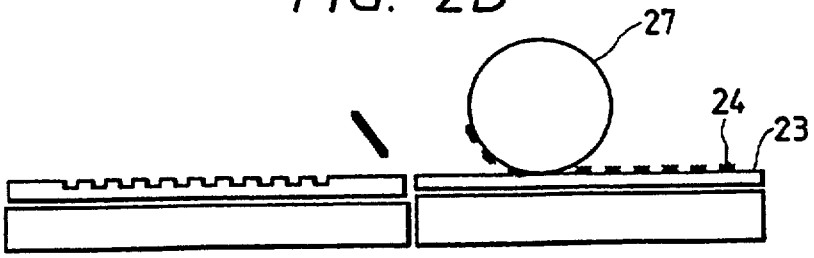
Figure 3A:
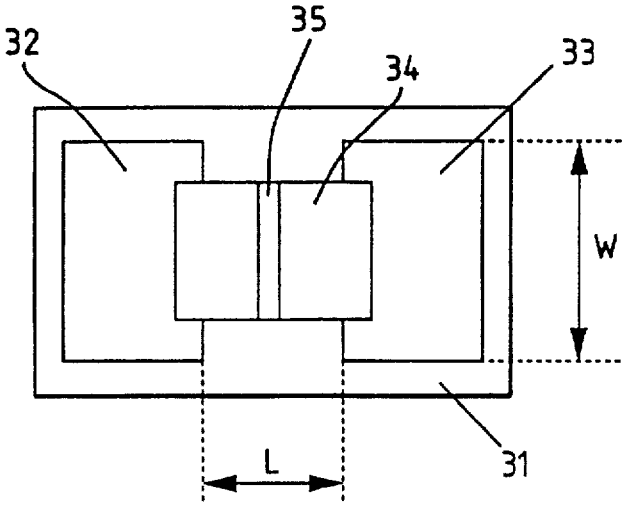
FIG. 3A PRIOR ART
Figure 3B:
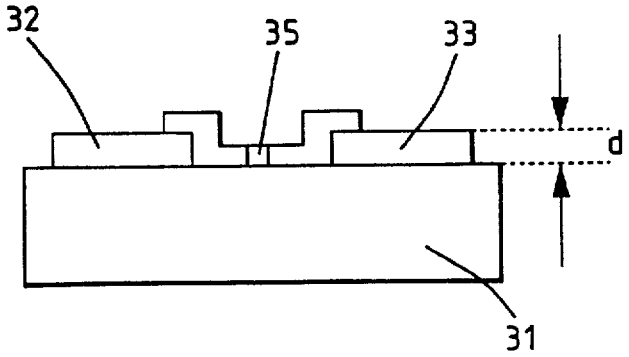
FIG. 3B PRIOR ART
Figure 4A:
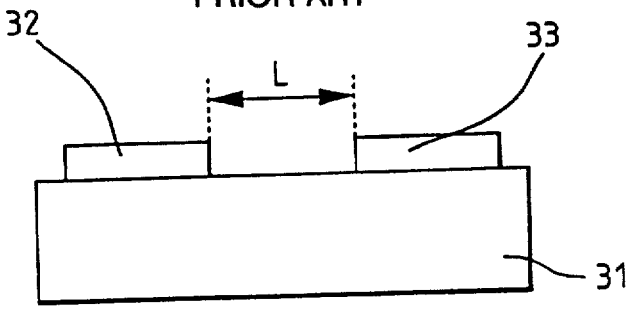
FIG. 4A PRIOR ART
Figure 4B:
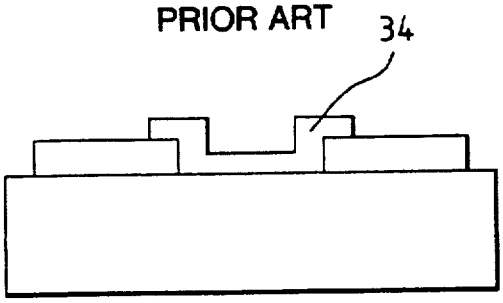
FIG. 4B PRIOR ART
Figure 4C:
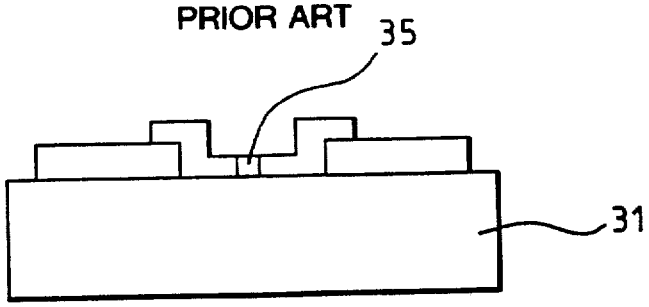
FIG. 4C PRIOR ART
Figure 6:
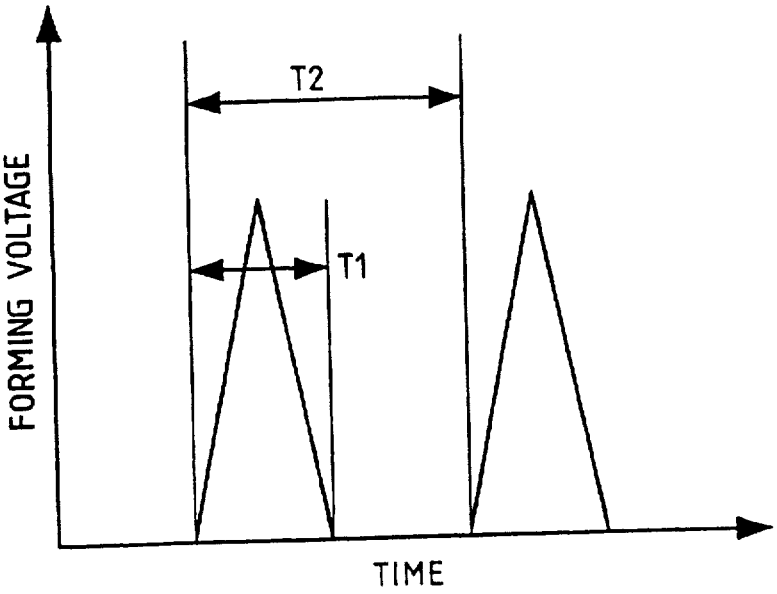
Figure 9:
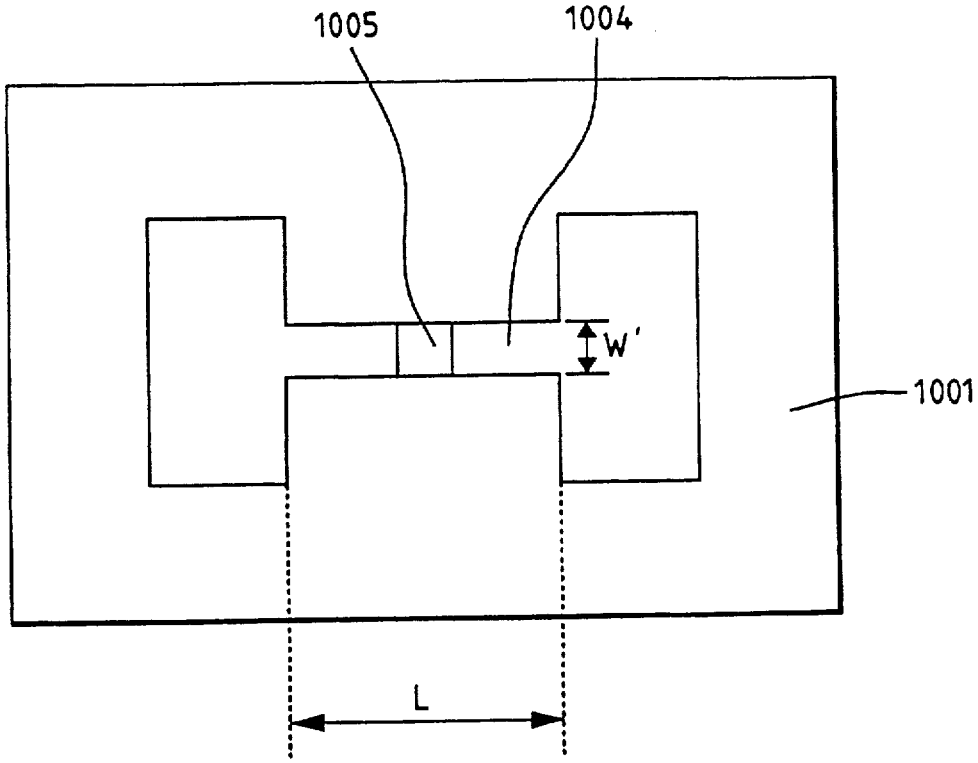
FIG. 9 PRIOR ART
Figure 7:
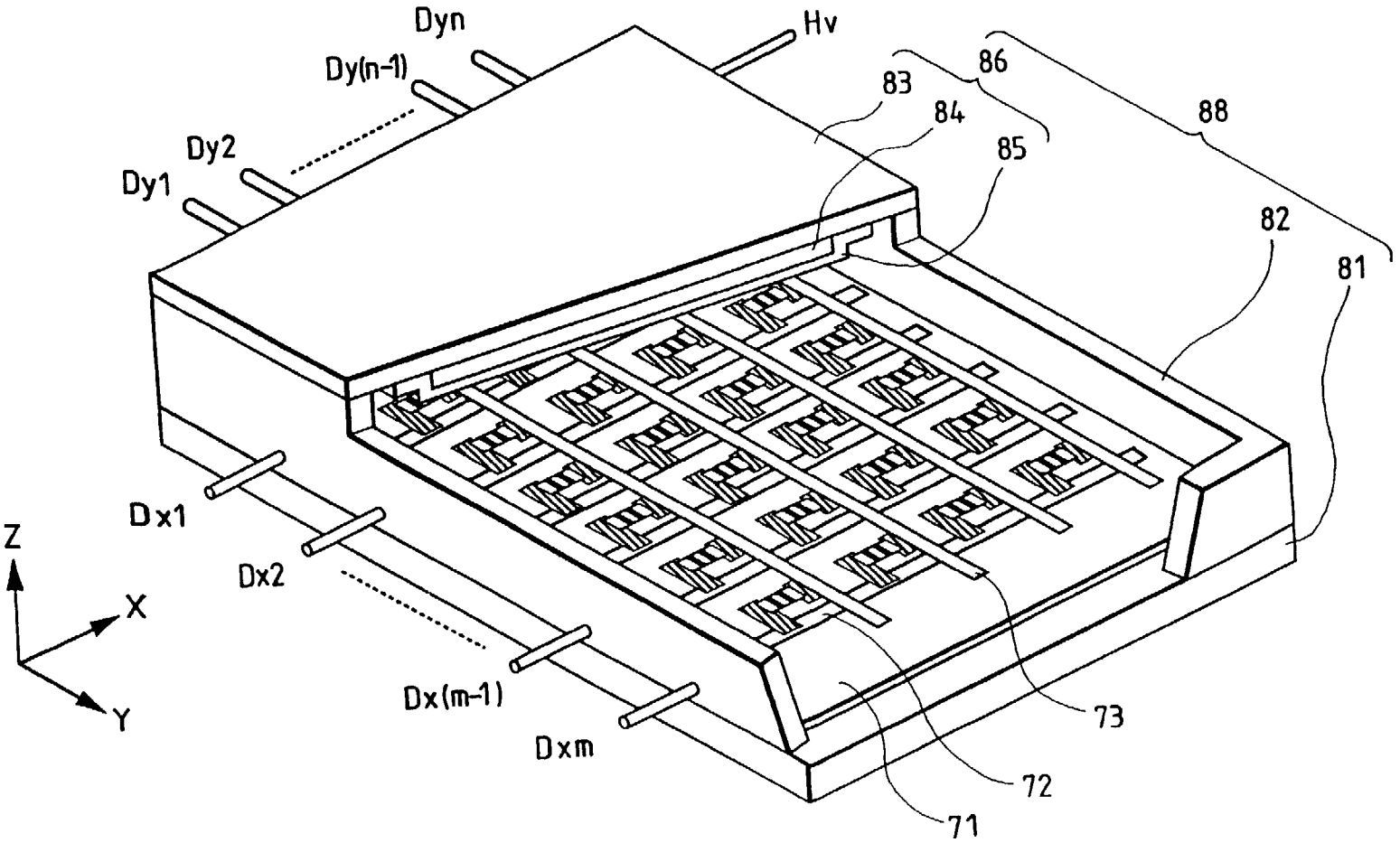

If the resultant display panel having the matrix-shaped interconnections is driven via a driving circuit such as that shown in FIG. 8, a TV image can be displayed on the display panel. The driving circuit shown in FIG. 8 will be described in further detail below.

In FIG. 8, reference numeral 901 denotes a display panel having matrix-shaped interconnections. The driving circuit includes a scanning circuit 902, a control circuit 903, a shift register 904, a line memory 905, a synchronizing signal extraction circuit 906, a modulation signal generator 907, and DC voltage sources Vx and Va.

The display panel 901 is connected to the external circuits via terminals Dox1 to Doxm, terminals Doy1 to Doyn, and a high-voltage terminal Hv. The electron source disposed on the display panel is driven via these terminals as follows. The surface conduction electron-emitting devices arranged in the form of an m×n matrix is driven row by row (n devices at a time) by a scanning signal applied via the terminals Dox1 to Doxm.

Via the terminals Doy1 to Doyn, a modulation signal is applied to each device in the line of surface conduction electron-emitting devices selected by the scanning signal thereby controlling the electron beam emitted by each device. A DC voltage of for example 10 kV is supplied from the DC voltage source Va via the high-voltage terminal Hv. This voltage is used to accelerate the electron beam emitted from each surface conduction electron-emitting device so that the electrons gain high enough energy to excite the phosphor.

The scanning circuit 902 operates as follows. The scanning circuit 902 includes m switching elements (S1 to Sm in FIG. 8). Each switching element selects either the voltage Vx output by the DC voltage source or 0 V (ground level) so that the selected voltage is supplied to the display panel 901 via the terminals Dox1 to Doxm. Each switching element S1 to Sm is formed with a switching device such as an FET. These switching elements S1 to Sm operate in response to the control signal Tscan supplied by the control circuit 903.

In this embodiment, the output voltage of the DC voltage source Vx is set to a fixed value so that devices which are not scanned are supplied with a voltage less than the electron emission threshold voltage of the surface conduction electron-emitting device.

The control circuit 903 is responsible for controlling various circuits so that an image is correctly displayed according to an image signal supplied from the external circuit. In response to the synchronizing signal Tsync received from the synchronizing signal extraction circuit 906, the control circuit 903 generates control signals Tscan, Tsft, and Tmry and sends these control signals to the corresponding circuits.

The synchronizing signal extraction circuit 906 is constructed with a common filter circuit in such a manner as to extract a synchronizing signal component and a luminance signal component from a television signal according to the NTSC standard supplied from an external circuit. Although the synchronizing signal extracted by the synchronizing signal extraction circuit 906 is simply denoted by Tsync in FIG. 8, the practical synchronizing signal consists of a vertical synchronizing signal and a horizontal synchronizing signal. The image luminance signal component extracted from the television signal is denoted by DATA in FIG. 8. This DATA signal is applied to the shift register 904.

The shift register 904 converts the DATA signal received in time sequence to a signal in parallel form line by line of an image. The above-described conversion operation of the shift register 904 is performed in response to the control signal Tsft generated by the control circuit 903 (this means that the control signal Tsft acts as a shift clock signal to the shift register 904). After being converted into the parallel form, image data is output line by line in the form of parallel signals consisting of Id1 to Idn from the shift register 904 (thereby driving n electron-emitting devices).

The line memory 905 stores one line of image data for a required time period. That is, the line memory 905 stores the data I'd1 to Idn under the control of the control signal Tmry generated by the control circuit 903. The contents of the stored data are output as data I'd1 to I'dn from the line memory 905 and applied to the modulation signal generator 907. The modulation signal generator 907 generates signals according to the respective image data I'd1 to I'dn so that each surface conduction electron-emitting device is driven by the corresponding modulation signals generated by the modulation signal generator 907 wherein the output signals of the modulation signal generator 907 are applied to the surface conduction electron-emitting devices of the display panel 901 via the terminal Doy1 to Doyn.

The electron-emitting device used in the present invention has fundamental characteristics in terms of the emission current Ic as described below. In the emission of electrons, there is a distinct threshold voltage Vth. That is, only when a voltage greater than the threshold voltage Vth is applied to an electron-emitting device, the electron-emitting device can emit electrons. In the case where the voltage applied to the electron-emitting device is greater than the threshold voltage, the emission current varies with the variation in the applied voltage. Therefore, when the electron-emitting device is driven by a pulse voltage, if the voltage is less than the electron emission threshold voltage, no electrons are emitted while an electron beam is emitted when the pulse voltage is greater than the threshold voltage. Thus, it is possible to control the intensity of the electron beam by varying the peak voltage Vm of the pulse. Furthermore, it is also possible to control the total amount of charge carried by the electron beam by varying the pulse width Pw.

As can be seen from the above discussion, either technique based on the voltage modulation or pulse width modulation may be employed to control the electron-emitting device so that the electron-emitting device emits electrons according to the input signal. When the voltage modulation technique is employed, the modulation signal generator 907 is designed to generate a pulse having a fixed width and having a peak voltage which varies according to the input data.

On the other hand, if the pulse width modulation technique is employed, the modulation signal generator 907 is designed to generate a pulse having a fixed peak voltage and having a width which varies according to the input data.

The shift register 904 and the line memory 905 may be of either analog or digital type as long as the serial-to-parallel conversion of the image signal and the storage operation are correctly performed at a desired rate.

When the digital technique is employed for these circuits, an analog-to-digital converter is required to be connected to the output of the synchronizing signal extraction circuit 906 so that the output signal DATA of the synchronizing signal extraction circuit 906 is converted from analog form to digital form. Furthermore, a proper type of modulation signal generator 907 should be selected depending on whether the line memory 905 outputs digital signals or analog signals. When a voltage modulation technique using digital signals is employed, the modulation signal generator 907 is required to include a digital-to-analog converter and an amplifier is added as required. In the case of the pulse width modulation, the modulation signal generator 907 is constructed for example with a combination of a high speed signal generator, a counter for counting the number of pulses generated by the signal generator, and a comparator for comparing the output value of the counter with the output value of the above-described memory. If required, an amplifier is further added to the above so that the voltage of the pulse-width modulation signal output by the comparator is amplified to a voltage large enough to drive the surface conduction electron-emitting devices.

On the other hand, in the case where a voltage modulation technique using analog signals is employed, an amplifier such as an operational amplifier is used as the modulation signal generator 907. A level shifter is added to that if required. In the case where the pulse width modulation technique is coupled with the analog technique, a voltage controlled oscillator (VCO) can be used as the modulation signal generator 907. If required, an amplifier is further added to the above so that the output voltage of the VCO is amplified to a voltage large enough to drive the surface conduction electron-emitting devices.

In the image display device constructed in the above-described manner according to the present invention, electrons are emitted by applying a voltage to each electron-emitting device via the external terminals Dox1 to Doxm, and Doy1 to Doyn. The emitted electrons are accelerated by a high voltage which is applied via the high voltage terminal Hv to a metal back 85 or a transparent electrode (not shown). The accelerated electrons strike a fluorescent film 84 so that an image is formed by light emitted by the fluorescent film.

Referring to specific embodiments, the present invention will be described in greater detail below.

Embodiment 1 and Comparative Example 1

Referring to FIGS. 1A, 1B, and 2A to 2D, the process of forming device electrodes by means of offset printing will be described below. In this embodiment, various intaglio plates having recessed portions with different depths were used, and the results were compared. First, a method of forming device electrodes of an electron-emitting device using an offset printing technique will be described.

FIGS. 2A to 2D are cross-sectional views illustrating the printing process. In these figures, reference numeral 21 denotes an ink supplying device, 22 denotes an intaglio metal plate made of a chrome-plated brass, and 29 denotes a recessed portion formed on the intaglio metal plate wherein the recessed portion is formed based on a pattern to be printed. Reference numeral 25 denotes ink composed of a platinum resinate paste which is supplied onto the intaglio metal plate 22. Reference numeral 26 denotes a doctor blade made of Swedish steel which slides across the surface of the intaglio metal plate 22 so that the ink is supplied into the recessed portions. Reference numeral 23 denotes a substrate made of blue sheet glass with a size of 40 cm×40 cmcm. Reference numeral 27 denotes a blanket covered with silicone rubber, which rotates and moves across the intaglio metal plate 22 and the substrate 23 while applying a pressure against the intaglio metal plate 22 and the substrate 23.

Figure 2A:
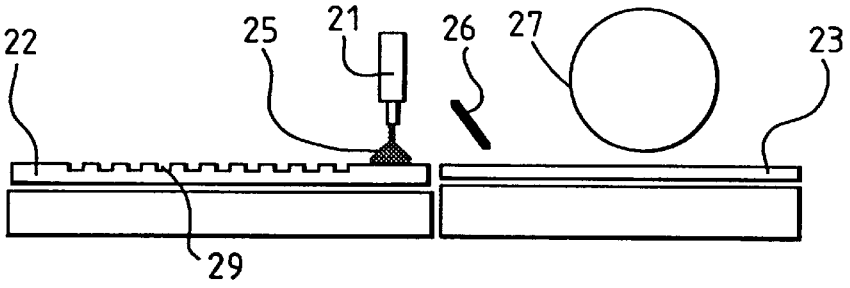
FIGS. 2A to 2D are schematic diagrams illustrating the process of forming device electrodes according to the present invention.
Figure 2B:
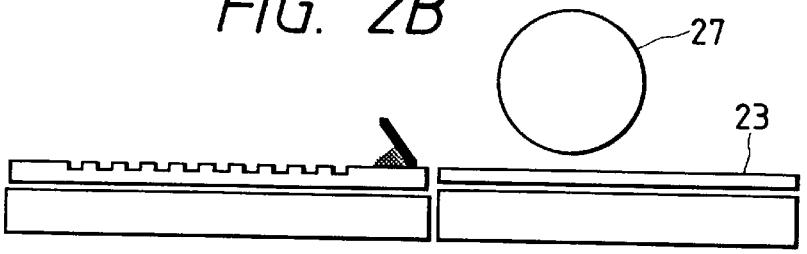
Figure 2C:
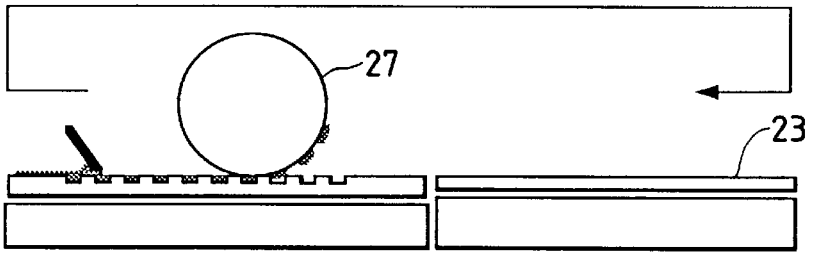

According to the present embodiment, ink 25 was placed on the intaglio metal plate 22 (FIG. 2A). Then the doctor blade 26 was slid across the surface of the intaglio metal plate 22 while pressing the surface of the intaglio metal plate 22 to the extent of 2 mm and maintaining the doctor blade 26 at an angle of 60° to the surface of the intaglio metal plate 22 thereby filling the recessed portions 29 with the ink 25 (FIG. 2B).

Then the blanket 27 was rotated and moved across the intaglio metal plate 22 while applying a pressure against it (FIG. 2C) so that the ink 25 was transferred onto the blanket 27.

Figure 2D:
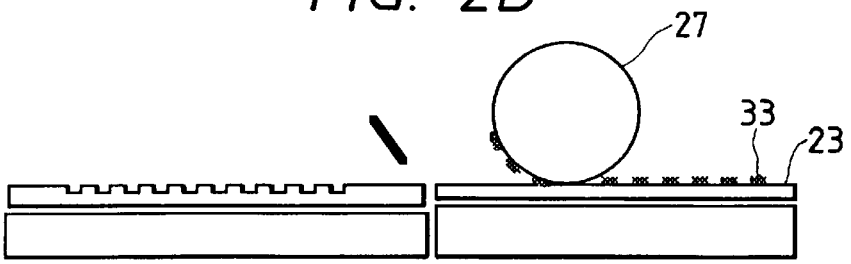

The blanket 27 was then rotated and moved across the surface of the substrate 23 while applying a pressure against it so that the ink was further transferred onto the surface of the glass substrate 23 thereby forming a device electrode pattern 24 (FIG. 2D).

In this embodiment, the ink 25 consisting of a platinum resinate paste (containing 7 wt % metal) having a viscosity of 7000 cps was used. In all cases, the printing was performed under a pressure of 50 μm against the intaglio plate and under a printing pressure of 50 μm. The viscosity of the ink was evaluated using a cone plate tool having a cone diameter of 20 cm and a cone angle of 5°. Six different intaglio metal plates 22 were used wherein the recessed portions 29 corresponding to the printing pattern were formed on the surface of intaglio metal plates with a depth of 4, 7, 9, 12, 15, and 20 μm, respectively. The device electrode pattern used in this embodiment consists of a large number of pairs of electrodes arranged in a matrix form wherein one electrode of each pair has a rectangular shape with a size of 500 μm×150 μm and the other electrode of each pair has a rectangular shape with a size of 350 μm×200 μm, the electrodes being disposed at locations separated from each other by a 20 μm gap.

After the completion of transferring the ink onto the glass substrate, the glass substrate was dried in an oven at 80° C. for 10 min and then baked in a belt conveyor furnace at a peak temperature of 580° C. for 10 min. Thus, device electrodes having quality good enough to be used in practical applications were formed except for the case where the intaglio plate having a recess depth of 20 μm was used. The results are summarized in Table 1.

TABLE 1

| Depth of recessed portions (μm) | | 4 | 7 | 9 | 12 | 15 | 20 |
|---|---|---|---|---|---|---|---|
| Shape of electrodes in a peripheral area | pattern shape | ○ | ◎ | ◎ | ○ | Δ | x |
| | gap | ◎ | ◎ | ◎ | ○ | ○ | x |
| | uniformity of film thickness | ○ | ○ | ◎ | ○ | Δ | x |
| Uniformity of electrode pattern among a large number of devices | | ◎ | ◎ | ◎ | Δ | Δ | x |

NOTE: ◎: excellent; ○: good; Δ: usable; x: unusable
Printing pressure = 50 μm; Intaglio pressure = 50 μm Embodiment 2

Device electrodes were formed in a manner similar to Embodiment 1 except that a platinum resinate paste having a viscosity of 1000 cps or 5000 cps was employed instead of the paste having a viscosity of 7000 cps (containing 7 wt % metal) used in Embodiment 1, and except that intaglio plates having recess depths of 4, 7, 9, and 12 μm, respectively, were used. Both inks having a viscosity of 1000 cps and 5000 cps showed similar results as shown in Table 2.

TABLE 2

| Depth of recessed portions (μm) | | 4 | 7 | 9 | 12 |
|---|---|---|---|---|---|
| Shape of electrodes in a peripheral area | pattern shape | ◎ | ◎ | ◎ | ◎ |
| | gap | ◎ | ◎ | ◎ | ◎ |
| | uniformity of film thickness | ○ | ◎ | ◎ | ○ |
| Uniformity of electrode pattern among a large number of devices | | ◎ | ◎ | ◎ | Δ |

NOTE: ◎: excellent; ○: good; Δ: usable
Printing pressure = 50 μm; Intaglio pressure = 50 μm Embodiment 3

Device electrodes were formed in a manner similar to Embodiment 1 except that the platinum resinate paste used in Embodiment 1 (having a viscosity of 7000 cps and containing 7 wt % metal) was replaced by a resinate paste containing 5, 10, or 15 wt % platinum. Furthermore, an intaglio plate having a recess depth of 7 μm or 9 μm was employed. The results are summarized in Table 3. As shown in Table 3, there is no significant difference between the intaglio plates having a recess depth of 7 μm and 9 μm.

TABLE 3

| Metal Content (%) | | 5 | 10 | 20 |
|---|---|---|---|---|
| Shape of electrodes in a peripheral area | pattern shape | ◎ | ◎ | ◎ |
| | gap | ◎ | ◎ | ◎ |
| | uniformity of film thickness | ○ | ◎ | ◎ |
| Uniformity of electrode pattern among a large number of devices | | ◎ | ◎ | ◎ |

NOTE: ◎: excellent; ○: good;
Depth of recessed portions = 7 μm, 9 μm;
Printing pressure = 50 μm; Intaglio pressure = 50 μm Although a platinum resinate paste was used in the embodiments described above, platinum may be replaced by Au, Pd, or Ag. Furthermore, the printing pressure may have a value in the range from 50 μm to 200 μm.

Embodiment 4

If a thin electrically-conductive film is added to the above-described substrate and interconnections are formed, a substrate for an electron source is obtained. If a front plate coated with a fluorescent material is disposed so that it faces the electron source substrate thereby forming a vaccuum chamber, an image-forming apparatus is obtained. The process of forming a substrate for an electron source and an image-forming apparatus will be described in greater detail below referring to FIGS. 5A to 5E.

Figure 5A:
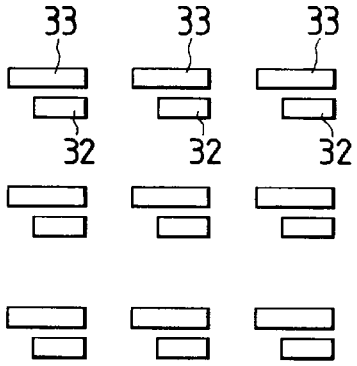
FIGS. 5A to 5E are schematic diagrams illustrating the process of producing an electron source substrate with matrix-shaped interconnections.
Figure 5B:
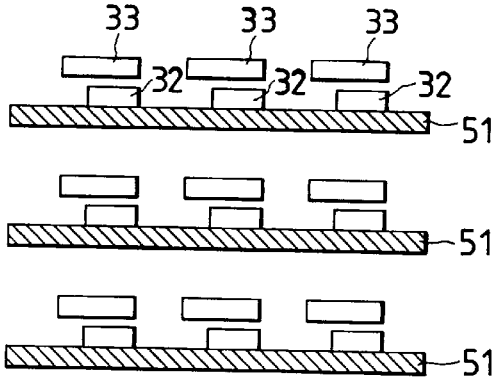

An electron source substrate with a size of 40 cm square having a large number of pairs of device electrodes 32 and 33 was prepared according to Embodiment 1, 2 or 3. A first interconnection (lower level interconnection) was formed on the substrate. That is, a lower-level interconnection pattern 51 having a thickness of 12 μm and a width of 100 μm was formed by means of a screen printing technique using a silver paste as an electrically conductive paste and then baked (FIG. 5B).

Figure 5C:
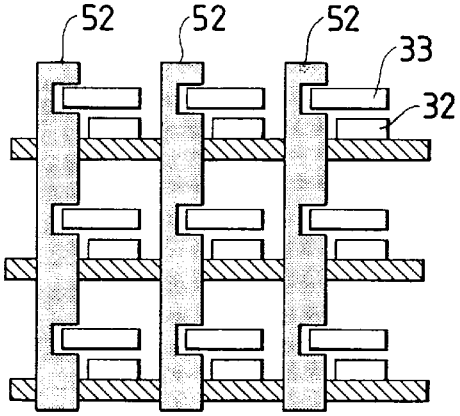

Then an interlayer insulating film pattern extending in a direction perpendicular to the lower-level interconnection pattern was formed by means of a screen printing technique using a thick film paste including lead oxide as a main ingredient mixed with a glass binder and a resin. Screen printing with a thick film paste and baking thereafter were performed twice thereby forming the interlayer insulating film 52 into a stripe form (FIG. 5C).

Figure 5D:
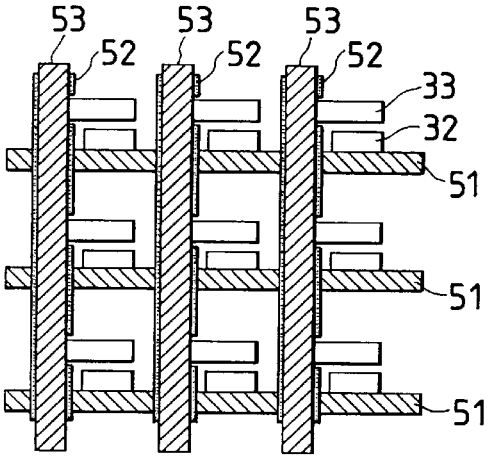

Then a second interconnection pattern (upper-level interconnection pattern) 53 having a thickness of 12 μm and a width of 100 μm was formed using a screen printing technique similar to that used to form the lower-level interconnection pattern. Thus matrix-shaped interconnections consisting of stripe-shaped lower-level interconnections and stripe-shaped upper-level interconnections crossing each other at a right angle (FIG. 5D).

Figure 5E:
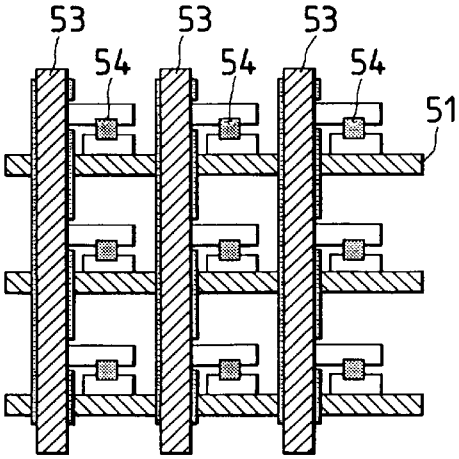
Figure 5E:
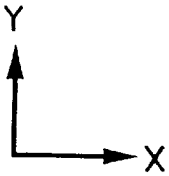

Then electron emission regions were formed as follows. First, organic palladium (CCP4230 available from Okuno Seiyaku Kogyo Co., Ltd.) was coated on the substrate on which the device electrodes 32 and 33 and the interconnections 51 and 53 were formed already, then heated at 300° C. for 10 min thereby forming an electrically-conductive thin film 54 with a thickness of 10 nm mainly consisting of Pd particles. This thin film 54 contains a mixture of a plurality of particles. The particles may be dispersed in the film, or otherwise the particles may be disposed so that they are adjacent to each other or they overlap each other (or may be disposed in the form of islands). The diameter of the particles refers to the diameter of such particles present in the above-described states. The palladium film was patterned by means of photolithography. Thus, a substrate for an electron source was obtained (FIG. 5E).

An image-forming apparatus was produced using the above substrate for the electron source as described below referring to FIG. 7.

The substrate 71 for the electron source having the matrix-shaped interconnections 72 and 73 was fixed onto a rear plate 81. A glass substrate 83 (front plate 86) having black stripes (not shown), a fluorescence material 84, and a metal back 85 was disposed so that it faces the substrate 71 for the electron source via a supporting frame 82, and these elements were sealed with frit glass.

Figure 6:
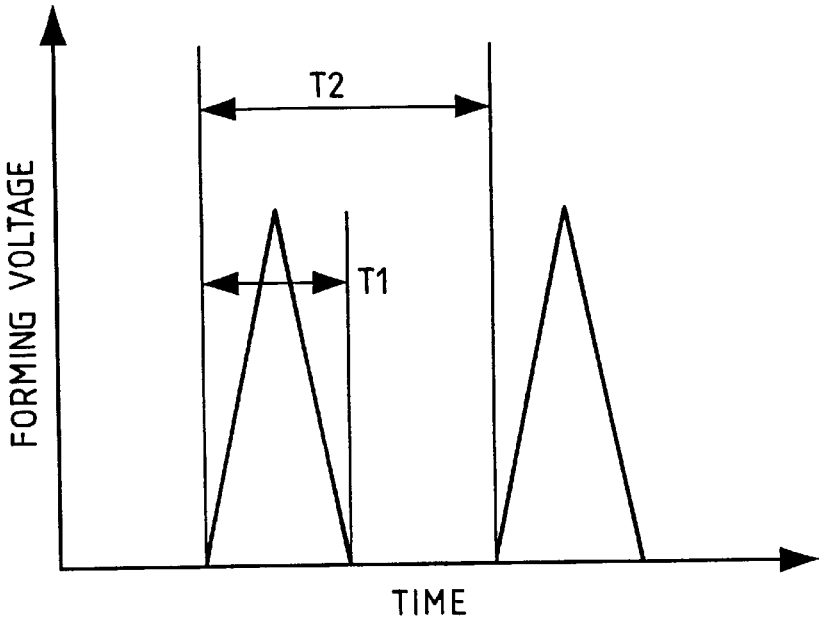
FIG. 6 is a schematic diagram of a waveform of a forming voltage.

The vaccuum chamber was thus formed as a result of the process described above, and the gas inside the vacuum chamber was evacuated via an exhaust tube (not shown) until the pressure in the vacuum chamber became low enough. Then a voltage was applied between the device electrodes of each surface conduction electron-emitting device via the external terminals Dx1 to Dx1 and Dy1 to Dym so that the electrically-conductive thin film was subjected to a forming process thereby forming electron emission regions. The forming process was performed using a voltage having a waveform with a pulse width T1 and a pulse interval T2 as shown in FIG. 6.

In this embodiment, T1 was set to 1 msec and T2 to 10 msec. The peak voltage of the triangular waveform was set to 14 V. After completion of the forming process at a low pressure of about 1×10−6 Torr, the exhaust tube (not shown) was burnt off with a gas burner thereby sealing the case (envelope) 88. Furthermore, gettering was performed so as to obtain a low enough pressure in the case 88 after sealed.

The resultant display panel was connected to the driving circuit shown in FIG. 8 so that a TV image was displayed on the panel. Thus, a complete image display device was obtained. A great number of device electrodes formed in this image display device had small variations in dimensions, and thus the image display device showed excellent ability of displaying a high-quality of image, and no degradation in the displaying ability was observed for a long time duration.

What is claimed is:

1. A method of producing an electron source, said electron source including on a substrate a plurality of first wires, a plurality of second wires provided so that said second wires intersect with said first wires and are electrically insulated from said first wires, and a plurality of surface conduction electron-emitting devices arranged in a matrix pattern, each of said electron-emitting devices including a pair of electrodes electrically connected to one of said first wires and one of said second wires and an electroconductive thin film containing particles and having an electron-emitting region between said pair of electrodes, comprising steps of:

forming on a substrate a plurality of pairs of electrodes as a film having a thickness less than 200 nm by means of offset printing:

forming said plurality of first wires using screen printing means so that one of each pair of electrodes is electrically connected thereto;

forming an insulating layer at the intersections of said first wires and said second wires;

forming said plurality of second wires using screen printing means so that the other of each pair of electrodes is electrically connected thereto; and forming a plurality of electroconductive thin films on said substrate and said electrodes so that said electroconductive thin films overlap with said electrodes.

2. A method according to claim 1, wherein said step of forming a plurality of pairs of electrodes comprises steps of:

preparing an intaglio plate having recessed portions corresponding to a pattern of said electrodes, the depth of said recessed portions being in the range from 4 μm to 15 μm;

filling said recessed portions with ink;

pressing a blanket against said intaglio plate so that the ink is transferred from the inside of the recessed portions onto said blanket; and transferring the ink from said blanket onto said substrate.

3. A method according to claim 2, wherein the depth of said recessed portions is in the range from 4 μm to 12 μm.

4. A method according to claim 3, wherein the depth of said recessed portions is in the range from 4 μm to 9 μm.

5. A method according to claim 4, wherein the depth of said recessed portions is in the range from 7 μm to 9 μm.

6. A method according to claim 2, wherein the viscosity of said ink is in the range from 1000 cps to 10000 cps.

7. A method according to claim 6, wherein the viscosity of said ink is in the range from 1000 cps to 5000 cps.

8. A method according to claim 2, wherein said particles comprise an organometallic compound comprising a metal element.

9. A method according to claim 8, wherein the metal element of said organometallic compound is contained at a concentration in the range from 7% to 15% by weight.

10. A method according to claim 8, wherein the metal element of said organometallic compound is selected from the group consisting of Pt, Au, Pd, and Ag.

11. A method according to claim 2, wherein said blanket is pressed against said substrate to an extent in the range from 50 μm to 200 μm.

12. A method according to claim 2, wherein said blanket includes silicone rubber.

13. A method for producing an electron source provided with a plurality of surface conduction electron-emitting devices arranged in a matrix pattern, wherein each of said electron-emitting devices comprises a pair of electrodes with an electroconductive thin film sandwiched between said pair of electrodes, and a plurality of wirings electrically connected to said pair of electrodes, comprising steps of:

forming on a substrate plural pairs of electrodes having a thickness less than 200 nm according to an offset printing method;

forming said wirings on said substrate according to a screen printing method; and forming said electroconductive thin film overlapping said pairs of electrodes.

14. An electron source, said electron source including on a substrate a plurality of first wires, a plurality of second wires provided so that said second wires intersect with said first wires and are electrically insulated from said first wires, and a plurality of surface conduction electron-emitting devices arranged in a matrix pattern, each of said electron-emitting devices including a pair of electrodes electrically connected to one of said first wires and one of said second wires and an electrocondiictive thin film containing particles and having an electron-emitting region between said pair of electrodes, said election source being produced by a process comprising steps of:

forming on a substrate a plurality of pairs of electrodes as a film having a thickness less than 200 nm by means of offset printing;

forming said plurality of first wires using screen printing means so that one of each pair of electrodes is electrically connected thereto;

forming an insulating layer at the intersections of said first wires and said second wires;

forming said plurality of second wires using screen printing means so that the other of each pair of electrodes is electrically connected thereto; and forming a plurality of electroconductive thin films on said substrate and said electrodes so that said electroconductive thin films overlap with said electrodes.

15. An electron source according to claim 14, wherein said step of forming a plurality of pairs of electrodes comprises:

preparing an intaglio plate having recessed portions corresponding to a pattern of said electrodes, the depth of said recessed portions being in the range from 4 μm to 15 μm;

filling said recessed portions with ink;

pressing a blanket against said intaglio plate so that the ink is transferred from the inside of the recessed portions onto said blanket; and transferring the ink from said blanket onto said substrate.

16. An electron source according to claim 15, wherein the depth of said recessed portions in said intaglio plate is in the range from 4 μm to 12 μm.

17. An electron source according to claim 16, wherein the depth of said recessed portions in said intaglio plate is in the range from 4 μm to 9 μm.

18. An electron source according to claim 17, wherein the depth of said recessed portions in said intaglio plate is in the range from 7 μm to 9 μm.

19. An electron source according to claim 15, wherein the viscosity of said ink is in the range from 1000 cps to 10000 cps.

20. An electron source according to claim 19, wherein the viscosity of said ink is in the range from 1000 cps to 5000 cps.

21. An electron source according to claim 15, wherein said particles comprise an organometallic compound comprising a metal element.

22. An electron source according to claim 21, wherein the concentration of said metal element in said organometallic compound is in the range from 7% to 15% by weight.

23. An electron source according to claim 21, wherein the metal element of said organometallic compound is selected from the group consisting of Pt, Au, Pd and Ag.

24. An electron source according to claim 15, wherein said blanket is pressed against said substrate to an extent in the range from 50 μm to 200 μm.

25. An electron source according to claim 15, wherein said blanket includes silicone rubber.

26. An image-forming apparatus comprising the electron source as defined in any one of claims 14–25 and a further substrate having a fluorescent material, said further substrate being disposed facing said electron source.

* * * * *

UNITED STATES PATENT AND TRADEMARK OFFICE

CERTIFICATE OF CORRECTION

PATENT NO. : 5,996,488

DATED : December 7, 1999

INVENTOR(S) : YOSHIHIRO YANAGISAWA ET AL.

It is certified that error appears in the above-identified patent and that said Letters Patent is hereby corrected as shown below:

ON THE TITLE PAGE [56] References Cited:

FOREIGN PATENT DOCUMENTS, "04290295 10/1992 Japan"
should read --4-290295 10/1992 Japan--

SHEET 2:

FIG. 2D, substitute with FIG. 2d, as attached.

Figure 3A:
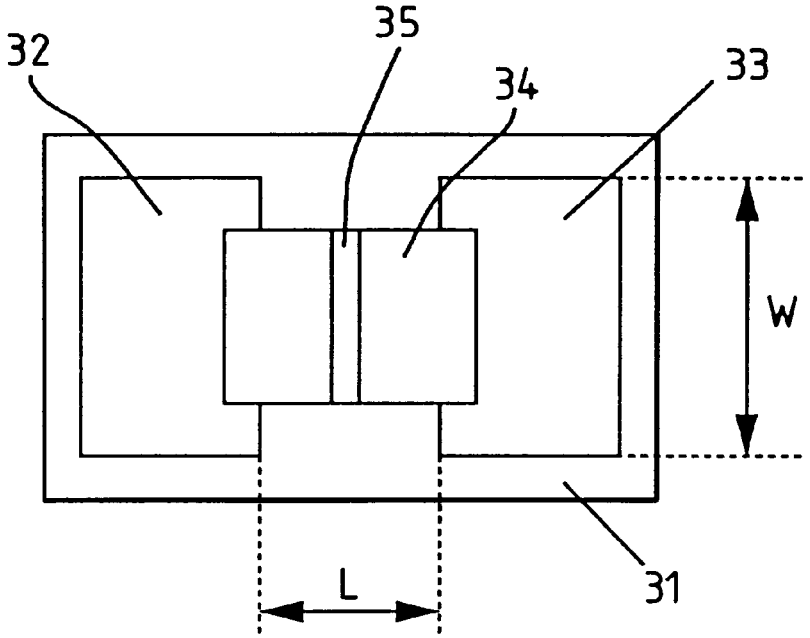
FIGS. 3A and 3B are schematic diagrams of a prior art surface conduction electron-emitting device.
Figure 3B:
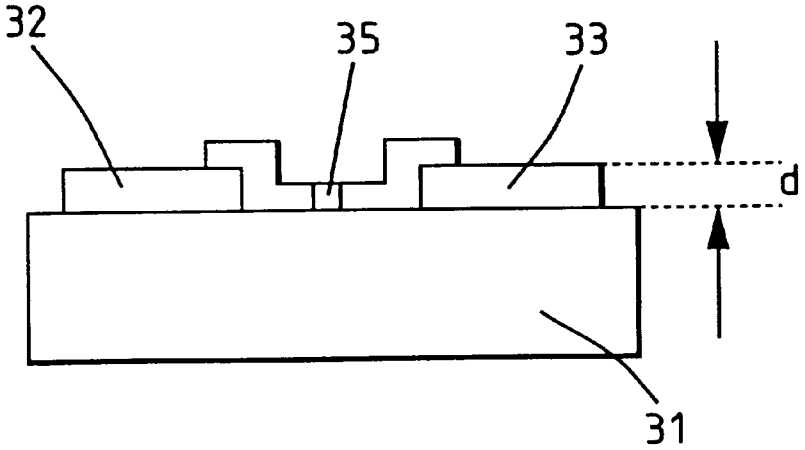

SHEET 3:

FIG. 3A and 3B, substitute with FIGS. 3A and 3D, as attached.

Figure 4A:
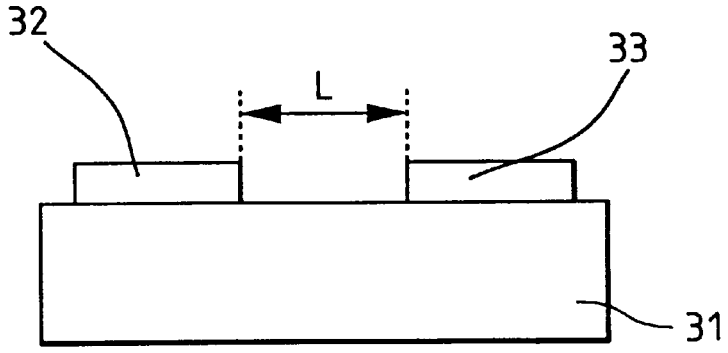
FIGS. 4A to 4C are schematic diagrams illustrating the process of producing the electron-emitting device shown in FIG. 3.
Figure 4B:
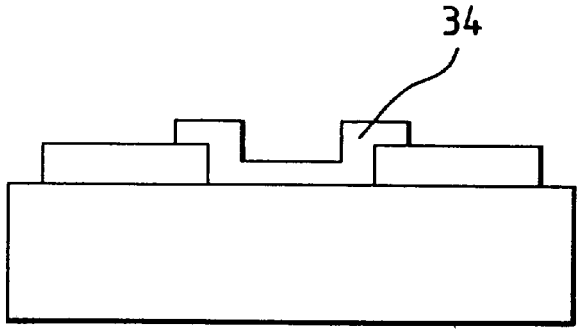
Figure 4C:
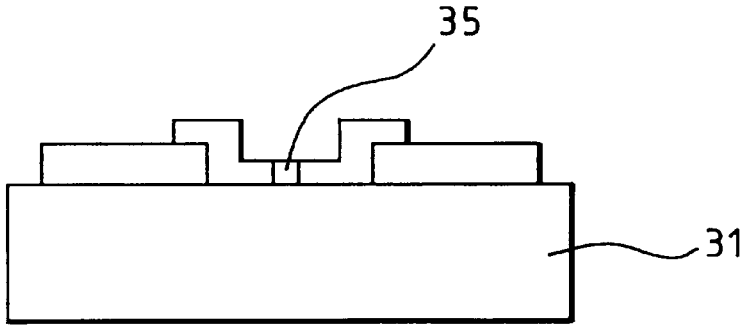

SHEET 4:

FIG. 4A-4C, substitute with FIGS. 4A-4C, as attached.

Figure 7:
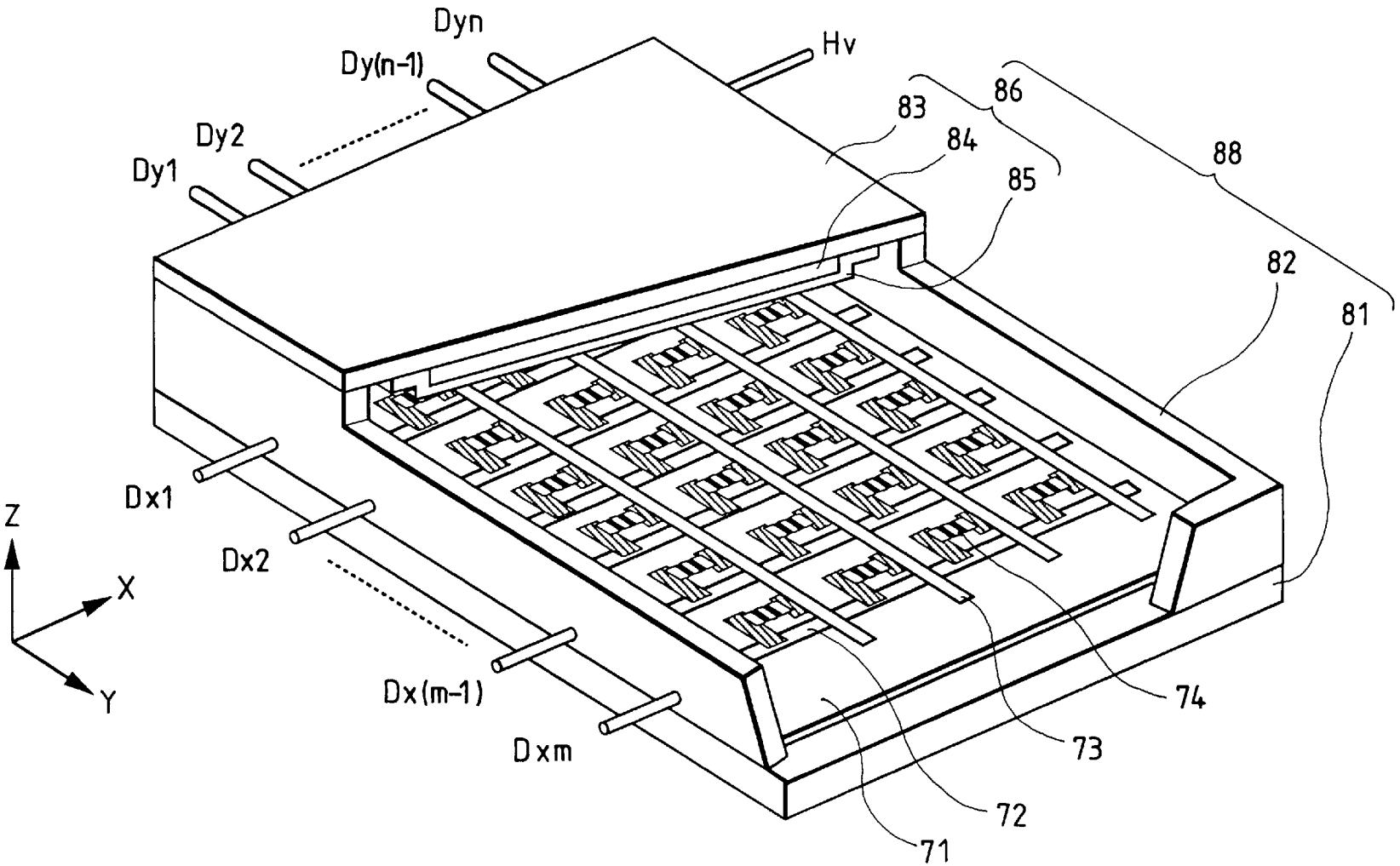
FIG. 7 is a schematic diagram of an image-forming apparatus produced according to the present invention.

SHEET 7:

FIG. 7, substitute with FIG. 7, as attached.

Figure 9:
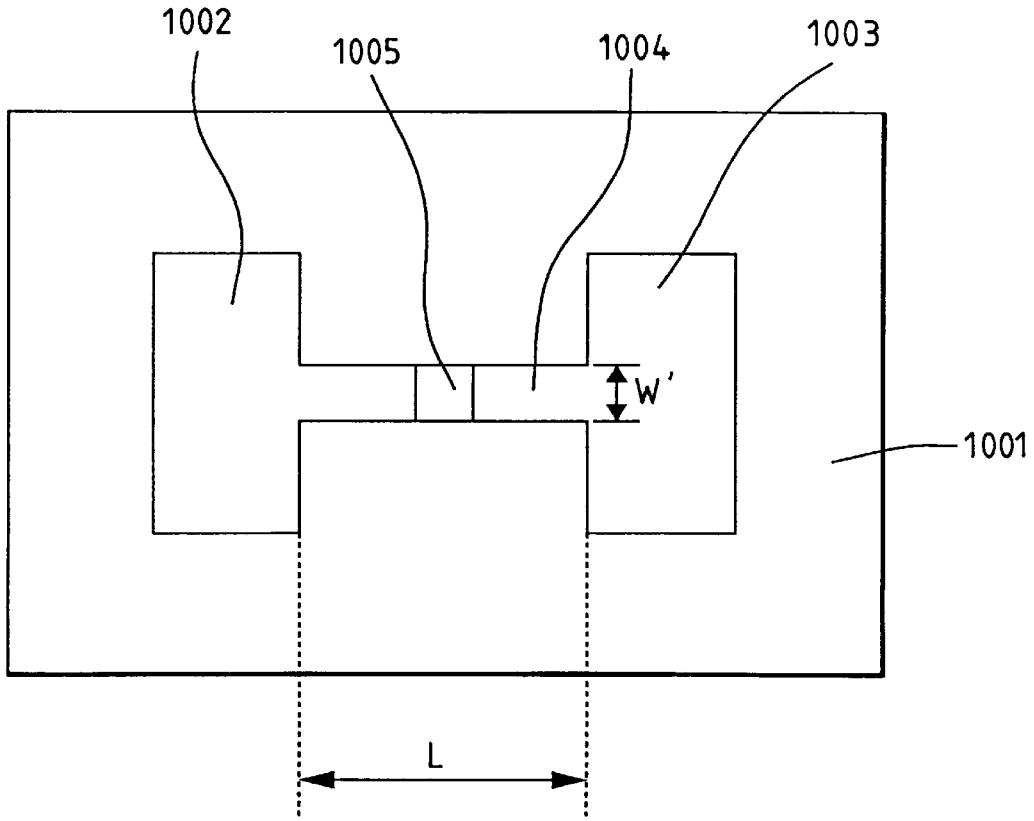
FIG. 9 is a schematic diagram illustrating a conventional surface conduction electron-emitting device.

SHEET 6:

FIG. 9, substitute with FIG. 9, as attached.

UNITED STATES PATENT AND TRADEMARK OFFICE

CERTIFICATE OF CORRECTION

PATENT NO. : 5,996,488

DATED : December 7, 1999

INVENTOR(S) : YOSHIHIRO YANAGISAWA ET AL.

It is certified that error appears in the above-identified patent and that said Letters Patent is hereby corrected as shown below:

COLUMN 1:

Line 14, "intention" should read --attention--; and
Line 39, "intention." should read --attention.--.

COLUMN 2:

Line 32, "shown" should read --shown in--.

COLUMN 7:

Line 1, ".no" should read --no--

COLUMN 8:

Line 24, "40cm x 40cmcm." should read --40cm x 40cm.--.

COLUMN 10:

Line 34, "(CCP4230" should read --(CCP 4230--.

UNITED STATES PATENT AND TRADEMARK OFFICE

CERTIFICATE OF CORRECTION

PATENT NO. : 5,996,488

DATED : December 7, 1999

INVENTOR(S) : YOSHIHIRO YANAGISAWA ET AL.

It is certified that error appears in the above-identified patent and that said Letters Patent is hereby corrected as shown below:

COLUMN 12:

Line 37, "electrocondiictive" should read --electro-conductive--; and
Line 39, "election" should read --electron--.

Signed and Sealed this

Twenty-fourth Day of April, 2001

Attest:

Nicholas P. Godici

NICHOLAS P. GODICI

Attesting Officer

Acting Director of the United States Patent and Trademark Office